US006752297B1

(12) United States Patent
Ische

(10) Patent No.: US 6,752,297 B1
(45) Date of Patent: Jun. 22, 2004

(54) WASTE REDUCING DISPENSING CONTAINER

(76) Inventor: Kenneth William Ische, 3881 Palisade Way, Eagan, MN (US) 55122-1709

( * ) Notice: Subject to any disclaimer, the term of this patent is extended or adjusted under 35 U.S.C. 154(b) by 0 days.

(21) Appl. No.: 10/248,963

(22) Filed: Mar. 5, 2003

(51) Int. Cl.[7] ..... B05B 7/00

(52) U.S. Cl. ..... 222/464.7; 222/382; 239/318; 239/337

(58) Field of Search ..... 222/382, 464.1, 222/464.7; 239/310, 318, 337

(56) References Cited

U.S. PATENT DOCUMENTS 3,180,580 A * 4/1965 Schedel ..... 239/318
3,240,398 A * 3/1966 Dalton, Jr. ..... 222/630
3,381,845 A * 5/1968 MacDonald ..... 220/301
3,940,069 A * 2/1976 Gunzel, Jr. et al. ..... 239/318
H1691 H * 11/1997 Ono et al. ..... 239/3
6,161,779 A * 12/2000 Oyler et al. ..... 239/310
6,648,201 B1 * 11/2003 Marinaro et al. ..... 227/95
2001/0032864 A1 * 10/2001 Shepherd ..... 222/321.5

* cited by examiner

*Primary Examiner*—J. Casimer Jacyna

(57) ABSTRACT

A container to be used with a spraying apparatus which aspirates a second liquid into a first liquid transported by a hose, or with a spraying apparatus which aspirates a liquid into a gas stream such as air. The container includes a downwardly sloped bottom surface to a low point which may include an attached well. A suction tube is used to aspirate the second liquid or liquid from the container. The distal end of the suction tube is located near the low point of the bottom surface to remove most of the liquid from the container.

6 Claims, 7 Drawing Sheets

(PRIOR ART)

WASTE REDUCING DISPENSING CONTAINER

BACKGROUND OF THE INVENTION

The present invention relates to an applicator which is attached to the end of a hose and aspirates a liquid from a container. Specifically, the present invention relates to a container which is contained within the applicator, where the container is designed to maximize the amount of liquid aspirated or otherwise removed from the container.

Applicators which spray a liquid are well known in the art. U.S. Pat. No. 5,474,210 discloses a liquid applicator which pressurizes the container by the use of a hand pump. The pressure created in the container forces the liquid through a spray nozzle.

U.S. Pat. No. 4,930,664 discloses a portable sprayer with a resealable closure, a dispensing valve, and a quick disconnecting one-way valve attached to a receptacle. As the container is filled through the one-way valve, the air inside of the container is compressed which pressurizes the sprayer. When the spray nozzle is opened, the pressure inside the container forces the liquid through the spray nozzle.

U.S. Pat. No. 4,901,023 discloses an aspirator type sprayer which is connected to an end of a hose. The sprayer includes a device to vary the dilution ratio of the liquid within a container with that of the liquid transported through the hose. The liquid within the container is aspirated into the liquid within the hose by a suction tube. The container disclosed in U.S. Pat. No. 4,901,023 has a bottom surface which has a crown shape where the high point of the bottom surface is in the middle of the container.

U.S. Pat. No. 5,195,664 discloses a hand held sprayer with a flexible pick up tube. The flexible pick up tube is weighted at the distal end of the tube to keep the distal end of the tube immersed in the liquid within the container. By keeping the distal end of the pick up tube immersed, more liquid is capable of being pumped out of the container.

U.S. Pat. No. 3,940,069 discloses an-aspirated sprayer which is connected to an end of a hose. A suction tube extends into a container which holds the liquid to be applied. The suction tube is located within a sediment trap within the upwardly crowned bottom surface of the container. The sediment trap and two screens in the suction tube prevent the spray nozzle from plugging with particles.

U.S. Pat. No. 4,527,740 discloses an aspirator sprayer which is attached to an end of a hose. The sprayer discloses a linearly actuated valve which is actuated by applying pressure to a lever. A suction tube which aspirates a liquid from a container is located near the edge of the bottom surface. The bottom surface of the container is crowned in the middle and sloped downwardly in all directions to the edge of the bottom surface.

U.S. Pat. No. 5,100,059 discloses a single valve aspiration type sprayer which is attached to an end of a hose. The unitary valve design provides controlled carrier fluid flow and controlled aspiration of the liquid within the sprayer. When the sprayer is not in use, the unitary valve acts as a seal which confines the liquid within the sprayer container.

U.S. Pat. No. 4,830,235 discloses a hand held sprayer. The sprayer includes a lever to siphon the liquid from a container through a pick up tube. The pick up tube is weighted, and the bottom surface contains legs which bias the pick up tube and the liquid to one side of the container. This configuration allows most of the liquid to be siphoned from the container.

U.S. Pat. No. 4,273,272 discloses a liquid dispenser with a flexible tube. The flexible tube is weighted such that when the dispenser is tilted, the liquid within the container and the flexible tube are in the same location allowing more liquid to be dispensed from the container.

U.S. Pat. No. 4,383,603 discloses an aspiration type sprayer which is connected to an end of a hose. The invention disclosed in the U.S. Pat. No. 4,383,603 includes a carrier liquid control valve and a rod valve which allows a liquid within a container to be aspirated into the liquid transported through the hose. When the rod valve is shut, the liquid within the container cannot be aspirated into the liquid within the hose.

U.S. Pat. No. 4,750,674 discloses an aspiration type sprayer which is attached to an end of a hose. The sprayer head includes a valve which seals the container from the liquid being transported through the hose when the valve is closed. When the valve is opened, the contents in the container are aspirated into the liquid within the hose.

U.S. Pat. No. 5,186,391 discloses a portable sprayer. The portable sprayer is pressurized by manipulating an air pump contained within the sprayer. When the spray nozzle is opened, the pressure within the container forces the liquid within the container through the spray nozzle.

U.S. Pat. No. 4,470,526 discloses a liquid dispensing container having a sloped bottom wall. A flexible plastic tube extends from a dispensing spout at its upper end to the lowest point of the bottom wall. In one embodiment the lower end of the tube fits loosely into a narrow downward hole in the apex of the bottom wall.

U.S. Pat. Nos. 5,366,119, 5,154,324, 5,558,252, 5,749,500, 5,062,549 and 5,464,129 disclose liquid dispensers employing containers with bottoms sloped toward the lowermost point. The purpose of these designs is to maximize liquid removal from the containers.

U.S. Pat. No. 5,485,942 discloses a liquid dispenser with a container having a sloped handle. The dispenser includes a tube from which liquid within the container is dispensed. An adapter is secured to the container such that the tube can be extracted from and inserted into the container allowing the dispenser to be moveable.

SUMMARY OF THE INVENTION

The present invention is a container used with a spraying apparatus which includes a suction tube which aspirates or draws liquid from the container. The container comprises a downwardly sloped bottom surface to form a low point. A distal end of the suction tube cooperates with the downwardly sloped bottom surface such that most of the liquid in the container is aspirated or drawn through the suction tube and applied by the spraying apparatus.

The container may be used in conjunction with a spraying apparatus which is attached to an end of a hose transporting a first liquid wherein the spraying apparatus includes a suction tube which aspirates a second liquid from the container. The container may also be used in conjunction with a spraying apparatus which is attached to the end of a hose transporting compressed gas, such as air. The spraying apparatus includes a tube through which liquid is aspirated from, or forced from the container, by the compressed gas, and applied by the spraying apparatus.

The advantage of the invention is to enable nearly all of the liquid in the container to be applied using the spraying apparatus. Waste is minimized because the liquid can be almost completely used. Potential environmental harm due to the disposal of the unusable portion of liquid from containers incorporated into conventional types of spray apparatuses is minimized.

Figure 1:
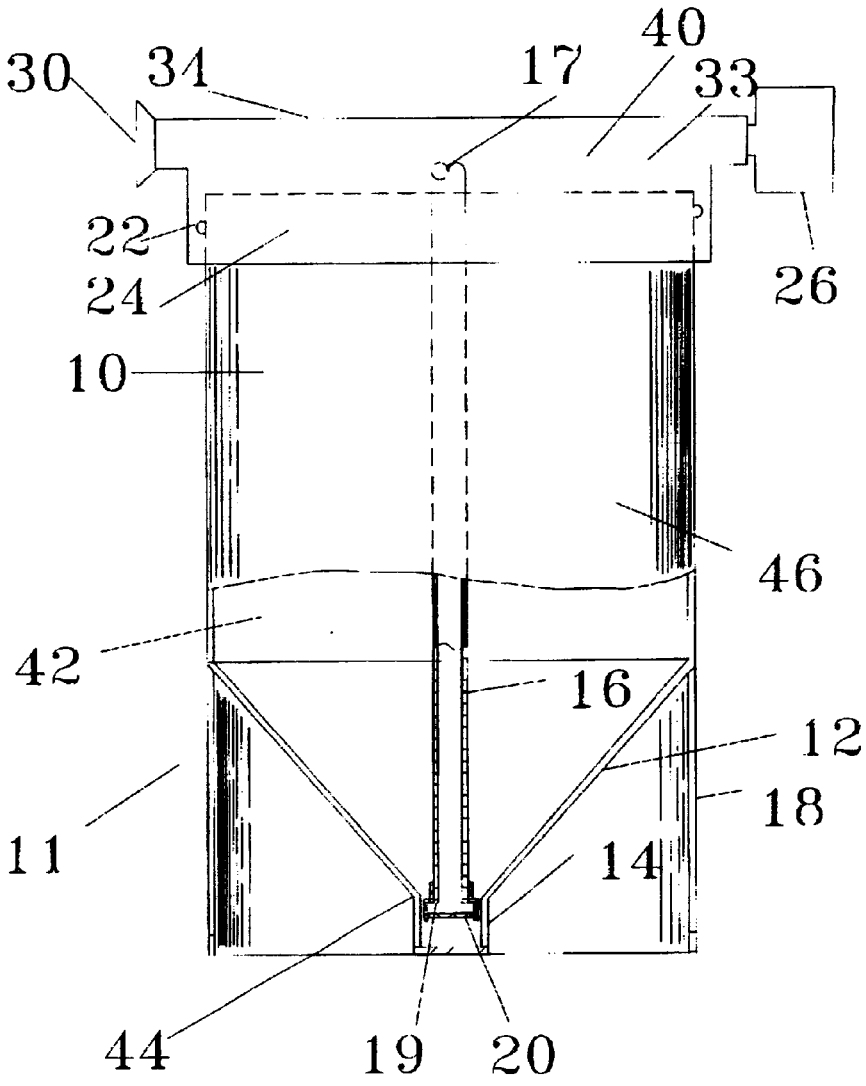
FIG. 1 is a sectional view of an applicator incorporating a container of the present invention.

[t1]
[Reference Numerals In Drawings]

| | |
|---|---|
| 10 | Container |
| 11 | Applicator |
| 12 | Container Bottom |
| 14 | Well |
| 16 | Pickup Tube (Suction Tube) |
| 17 | Proximal End of Suction Tube |
| 18 | Skirt |
| 19 | Distal End of Suction Tube |
| 20 | Strainer |
| 22 | Container Threads |
| 24 | Container Attachment Mechanism |
| 26 | Hose Coupling |
| 28 | Container Legs |
| 30 | Spray Nozzle |
| 33 | Spray Chamber or Chamber |
| 34 | hose end sprayer apparatus (such as Ortho Dial 'nSpray ®) |
| 40 | First Liquid |
| 42 | Second Liquid |
| 43 | Liquid Level |
| 44 | Low Point |
| 46 | Container Wall |
| 48 | Sprayer Handle |
| 52 | Cam-action Container Release Lever |
| 54 | Coating Spray Gun |
| 56 | Container Attachment Yoke |
| 58 | Container Attachment Pins |

DETAILED DESCRIPTION

An applicator 11, which is designed to be attached to an end of a hose (not shown), is generally illustrated in FIG. 1. The applicator 11 includes a container 10 and a spraying apparatus 34. The spraying apparatus 34 is well known in the art. A spraying apparatus 34 which is commercially available is the Ortho Dial'n Spray(r).

The spraying apparatus 34 includes a hose coupling 26 which attaches the spraying apparatus 34 to the end of the hose (not shown). The hose coupling 26 is preferably threaded and preferably threadably engages the end of the hose (not shown).

The spraying apparatus 34 contains a chamber 33 through which a first liquid 40, preferably water, flows. The first liquid 40 passes through the chamber 33 and exits the spray nozzle 30. The chamber 33 includes an aperture (not shown) into which a proximal end 17 of a suction tube 16 is inserted. As the first liquid 40 passes through the chamber 33 and past the proximal end 17 of the suction tube 16 within the chamber 33, a siphoning effect is created. When a distal end 19 of the suction tube 16 is submerged in a second liquid 42, the second liquid 42 is aspirated into the first liquid 40.

The spraying apparatus 34 includes a mechanism 24 for attaching the container 10 to the spraying apparatus 34. The mechanism 24 is preferably a threadable engagement between the mechanism 24 of the spraying apparatus 34 and a plurality of threads 22 on the container 10.

The container 10 contains the second liquid 42 which is to be aspirated through the suction tube 16 into the first liquid 40 and is applied through the spray nozzle 30.

The second liquid 42 is preferably, but not limited to herbicides, insecticides, and fertilizers which are typically applied to lawns and trees. A screen 20 is attached to the distal end 19 of the suction tube 16 to prevent particles suspended in the second liquid 42 from plugging the spray nozzle 30.

When the container 10 is attached to the spraying apparatus 34, the applicator 11 applies the second liquid 42 by aspirating the second liquid 42 through the suction tube 16. When the level of the second liquid 42 is below the distal end 19 of the suction tube 16, the applicator 11 will not be capable of aspirating the remaining liquid 42 within the container 10.

Figure 5:
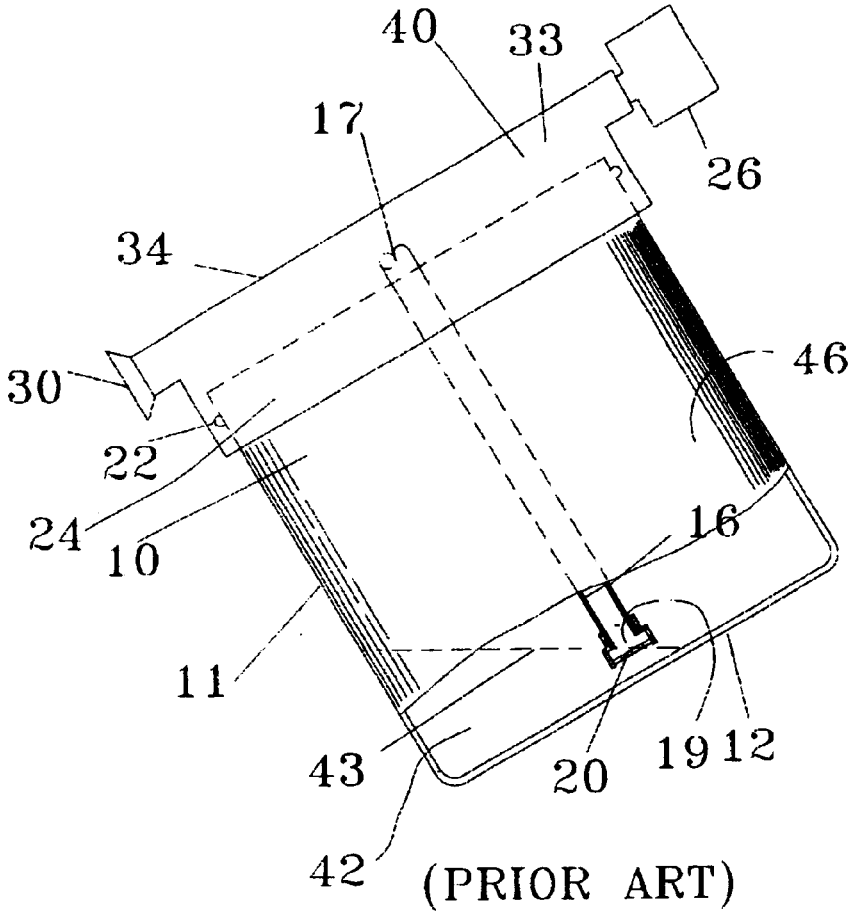
FIG. 5 is a sectional view of a prior art applicator included for the purpose of comparison to a container of the present invention.

A typical applicator 11 of the prior art is shown in FIG. 5 where the bottom surface 12 of the container 10 is flat or slightly crowned in the middle of the bottom surface 12. When the applicator 11 is tilted, which is typical, the level 43 of the second liquid 42 prematurely exposes the distal end 19 of the suction tube 16 preventing the remaining second liquid 42 from being aspirated through the suction tube 16. When the applicator 11 is positioned horizontally, a portion of the second liquid 42 will remain in the container 10 because of the space between the distal end 19 of the suction tube 16 and the bottom surface 12 of the container 10.

The second liquid 42 remaining in the container 10 will not be efficiently used because the person using the applicator 11 will dump the remaining second liquid 42 onto an area at a higher concentration than necessary resulting in potential environmental consequences. Additionally, disposal of the remaining second liquid 42 poses a health risk to the person using the applicator 11.

Figure 4:
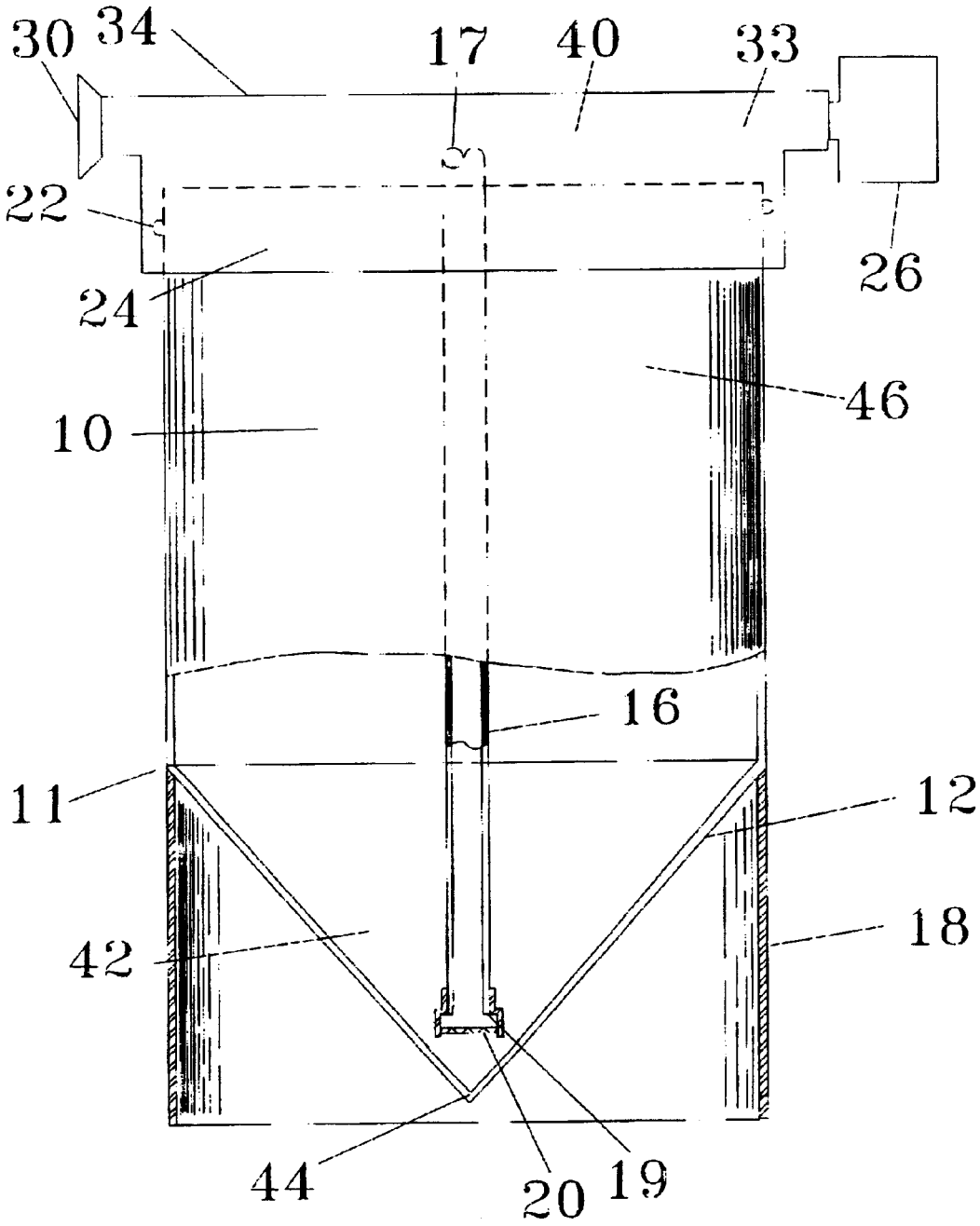
FIG. 4 is a sectional view of an applicator incorporating yet another alternative embodiment of a container of the present invention.
Figure 6:
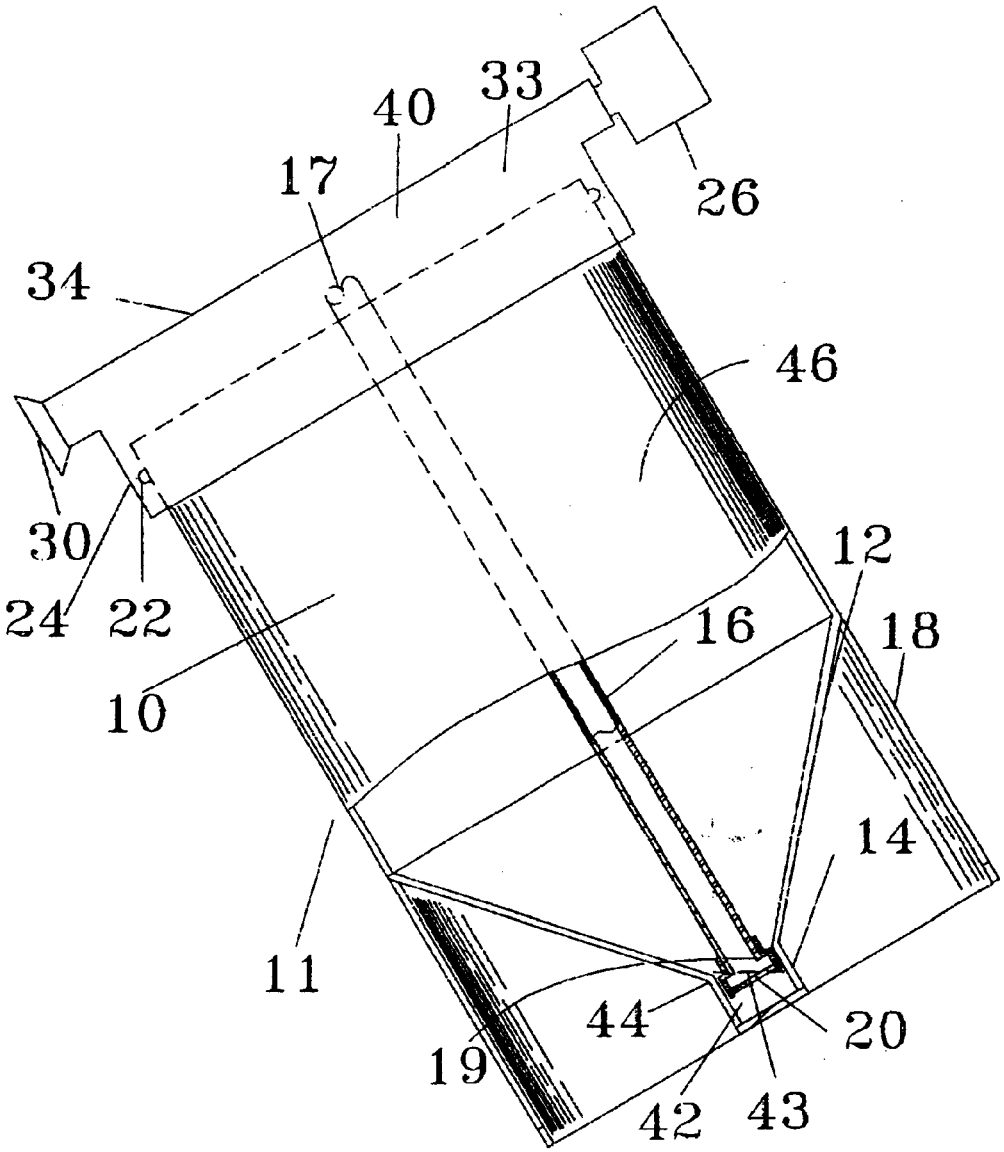
FIG. 6 is a sectional view of a container of the present invention for the purpose of comparison to a container of prior art.

The container 10 of the present invention maximizes the amount of the second liquid 42 being aspirated out of the container 10. This is illustrated by comparing the liquid level 43 and the volume of second liquid 42 remaining in FIG. 6, a container 10 of the present invention, and the liquid level 43 and the volume of the second liquid 42 remaining in FIG. 5, a container 10 of prior art. The bottom surface 12 of the container 10 is downwardly slanted to a low point 44 as illustrated in FIG. 4. The distal end 19 of the suction tube 16 is placed in cooperation with the low point 44 of the bottom surface 12, such that when the distal end 19 of the suction tube 16 is above the level of the second liquid 42, only a minimal amount of the second liquid 42 will remain in the container 10.

A well 14 is preferably connected to the low point 44 of the bottom surface 12 of the container 10 as illustrated in FIGS. 1, 2, 3, 6, and 7. The distal end 19 of the suction tube 16 is placed within the well 14 to maximize the amount of the second liquid 42 aspirated out of the container 10. Typically, the well 14 diameter is slightly larger than the distal end 19 of the suction tube 16 and strainer 20, which may be attached to the distal end 19 of the suction tube 16. As the ratio of the well 14 diameter to the diameter of the distal end 19 increases, the volume of second liquid that cannot be removed from container 10 increases, so minimizing this ratio minimizes the volume of liquid remaining in the well 14. When the distal end 19 of the suction tube 16 is above the level of the second liquid 42, the volume of the second liquid 42 remaining in the container 10 is limited by the space between the distal end 19 of the suction tube 16 and the bottom of the well 14. The well 14 together with the downwardly slanted bottom surface 12 of the container 10 effectively funnels or directs second liquid 42 to the distal end 19 of the suction tube 16. In effect the well 14 is a small container which is much more completely emptied by a suction tube 16 than is an applicator container 10 such as one shown in FIG. 5.

The angle of the downward slant of the bottom surface 12 relative to the horizon is determined by the angle through which the container 10 will be tilted during its use. For example, a container 10 requiring as much as a 45 degree tilt during its use, such as a container 10 which is combined with an insecticide or fertilizer applicator 34, can be built as a container 10 with a downward bottom surface 12 slope of preferably, 45–50 degrees. A container 10 that will be only be slightly tilted during use or not at all can be built as a container 10 with a downward bottom surface 12 slope of preferably 3–5 degrees. The angles of downward bottom surface 12 slope described are examples, but may be larger or smaller depending on the requirement of the applicator 34, or other apparatus to which the container 10 of the present invention has been joined to maximize removal of the container 10 contents.

The container 10 is preferably made of a transparent or translucent material, preferably a plastic material. An advantage of making the container 10 out of transparent or translucent material is that the amount of second liquid 42 is visible through a wall 46 of the container 10. The user can stop application of the second liquid 42 when the level of the second liquid 42 reaches the well 14 or low point 44 of the container 10. If the applicator 11 does not have to mix a first liquid 40 with a second liquid 42, the container 10 may be opaque because it will be obvious when the container 10 is empty since there will no longer be material other than the invisible propellant, such as air, exiting the applicator illustrated in FIG. 7. Although the wall 46 in FIGS. 1–4 and 6–7 is illustrated as cylindrical, the configuration of the wall 46 could alternatively be multi-sided, elliptical, or have other shapes. Additionally, a plurality of volume graduations (not shown) may be placed on the wall 46 of the container 10 to provide the user of the applicator 11 with an indication of the amount of the second liquid 42 remaining in the container 10. However, the volume graduations are not required or necessary on any embodiment for the container 10 of the present invention.

One preferred embodiment of the container 10 positions the well 14 which is attached to the bottom surface 12 of the container 10 to be substantially centrally located about a vertical axis of the container 10 as illustrated in FIG. 1. The container 10, as illustrated in FIG. 1, includes a skirt 18 which extends below the well 14. The skirt 18 provides a support structure for the applicator 11 which keeps the applicator 11 upright while the applicator 11 is not being used or the container 10 is being filled.

Preferably, the skirt 18 is made of a transparent material which allows the user of the applicator 11 to see the amount of the second liquid 42 remaining in the container 10 through the transparent or translucent sides of container 10. The user of the applicator 11 can stop the flow of first liquid 40 flowing through the chamber 33 when the last remaining second liquid 42 exits the well 14. If the user of the applicator 11 does not stop the flow of first liquid 40 when the last remaining second liquid 42 exits the well 14, the first liquid 40 exiting the applicator 11 will no longer contain a portion of second liquid 42, and will wash the second liquid 42 that has been dispersed onto plants such as lawn, trees, or other items in the environment off of these plants or other items.

Figure 2:
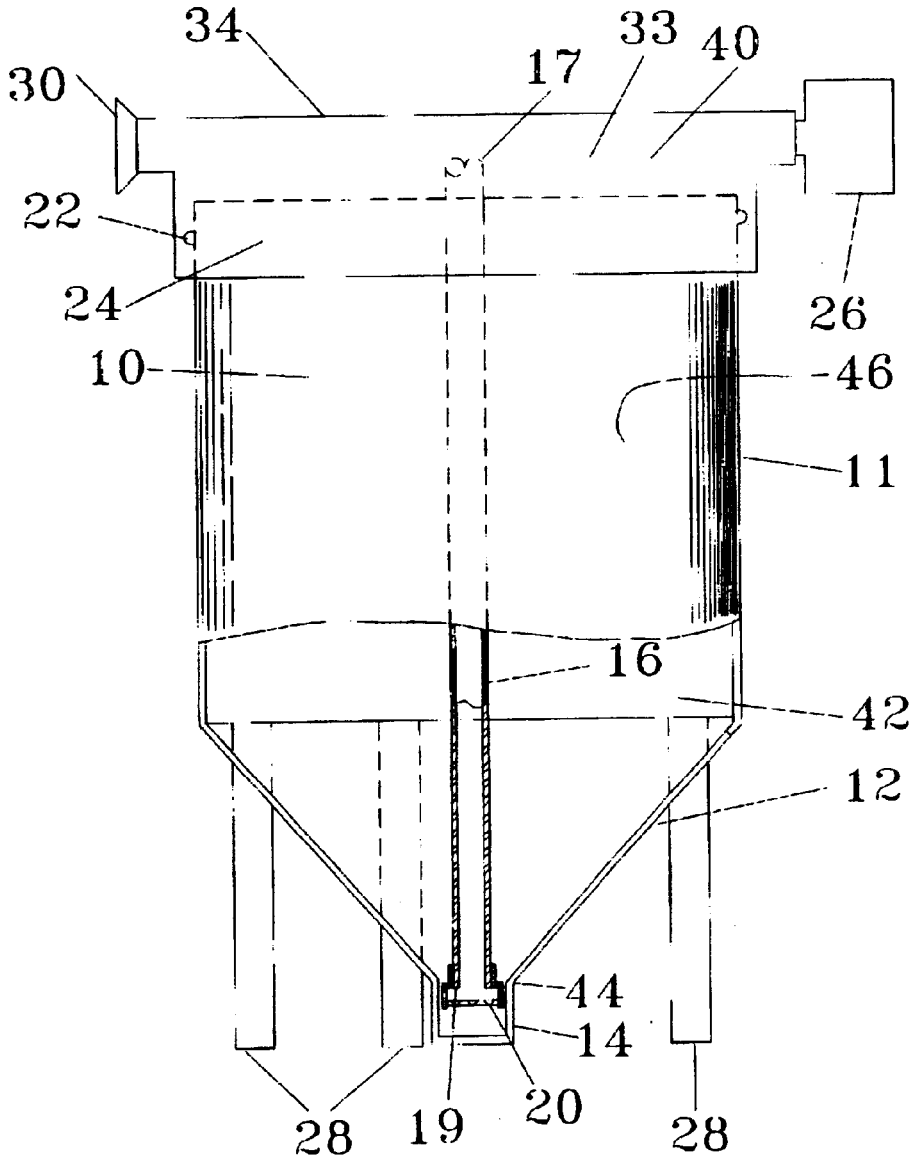
FIG. 2 is a sectional view of an applicator incorporating another alternative embodiment of a container of the present invention.

A second preferred embodiment of the container 10 is illustrated in FIG. 2. The container 10 includes a downwardly sloped bottom surface 12 to which the well 14 is attached. The well 14 is substantially centrally located about the vertical axis of the container 10. The container 10 is supported by a plurality of legs 28, allowing the applicator 11 to be placed down without tipping over. The plurality of legs 28 allow the user of the applicator 11 to see the amount of the second liquid 42 remaining in the container 10 through the transparent or translucent sides of container 10. As with the skirt 18, the legs 28 provide another type of support structure for the applicator 11 which keep the applicator 11 upright while the applicator 11 is not being used or the container 10 is being filled.

Figure 3:
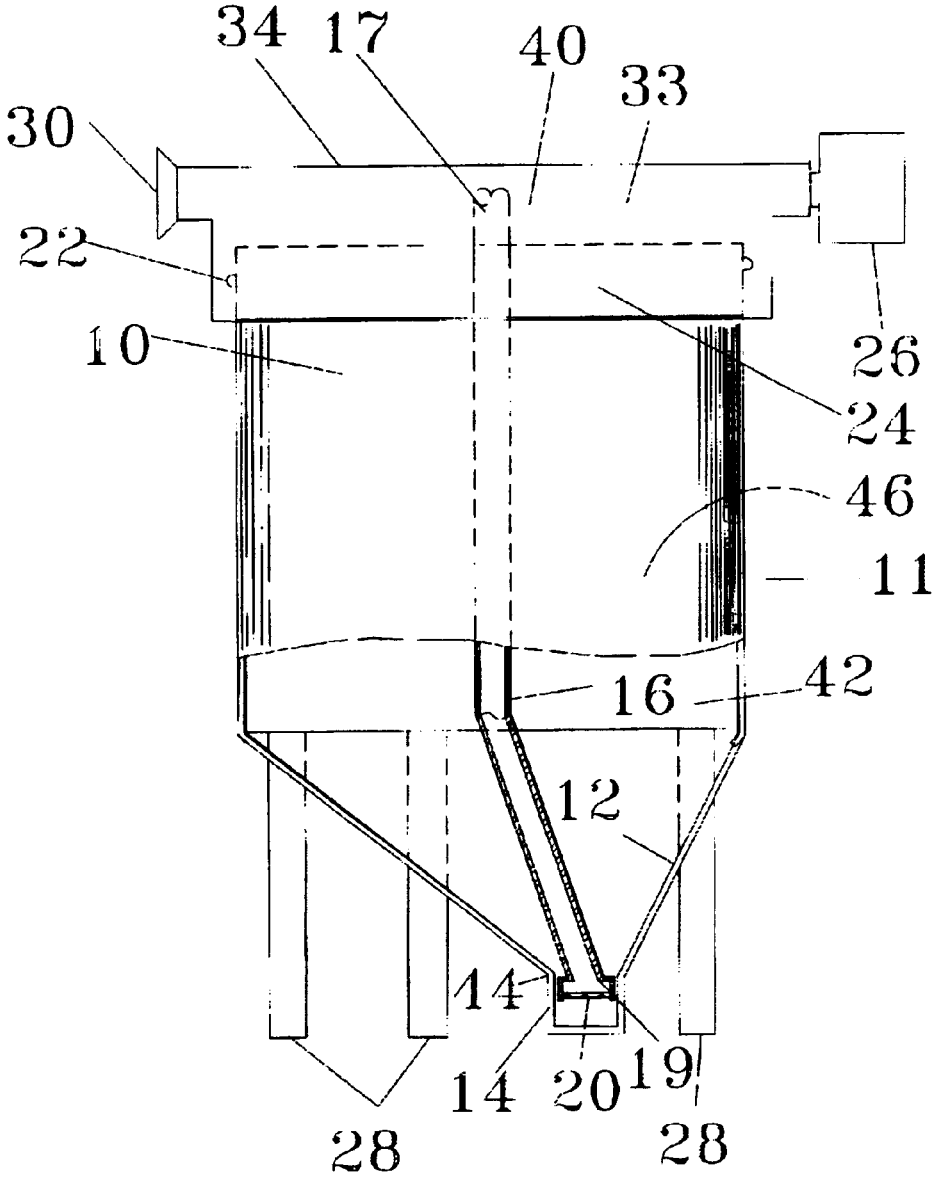
FIG. 3 is a sectional view of an applicator incorporating another alternative embodiment of a container of the present invention illustrating that the well of the container does not have to be symmetrical with the walls of the container.

A third preferred embodiment of the container 10 is illustrated in FIG. 3. The container 10 includes a downwardly sloping bottom surface 12 to which the well 14 is attached. The well 14 is offset from the vertical axis of the container 10 allowing the container 10 to be tilted but still aspirate most of the second liquid 42 from the container 10. The container 10, as illustrated in FIG. 3, includes a plurality of legs 28 to support the applicator 11. In addition to the configuration including the plurality of legs 28 to support the container 10 with the offset well 14, the skirt 18 as illustrated in FIG. 1 may support the container 10.

Figure 7:
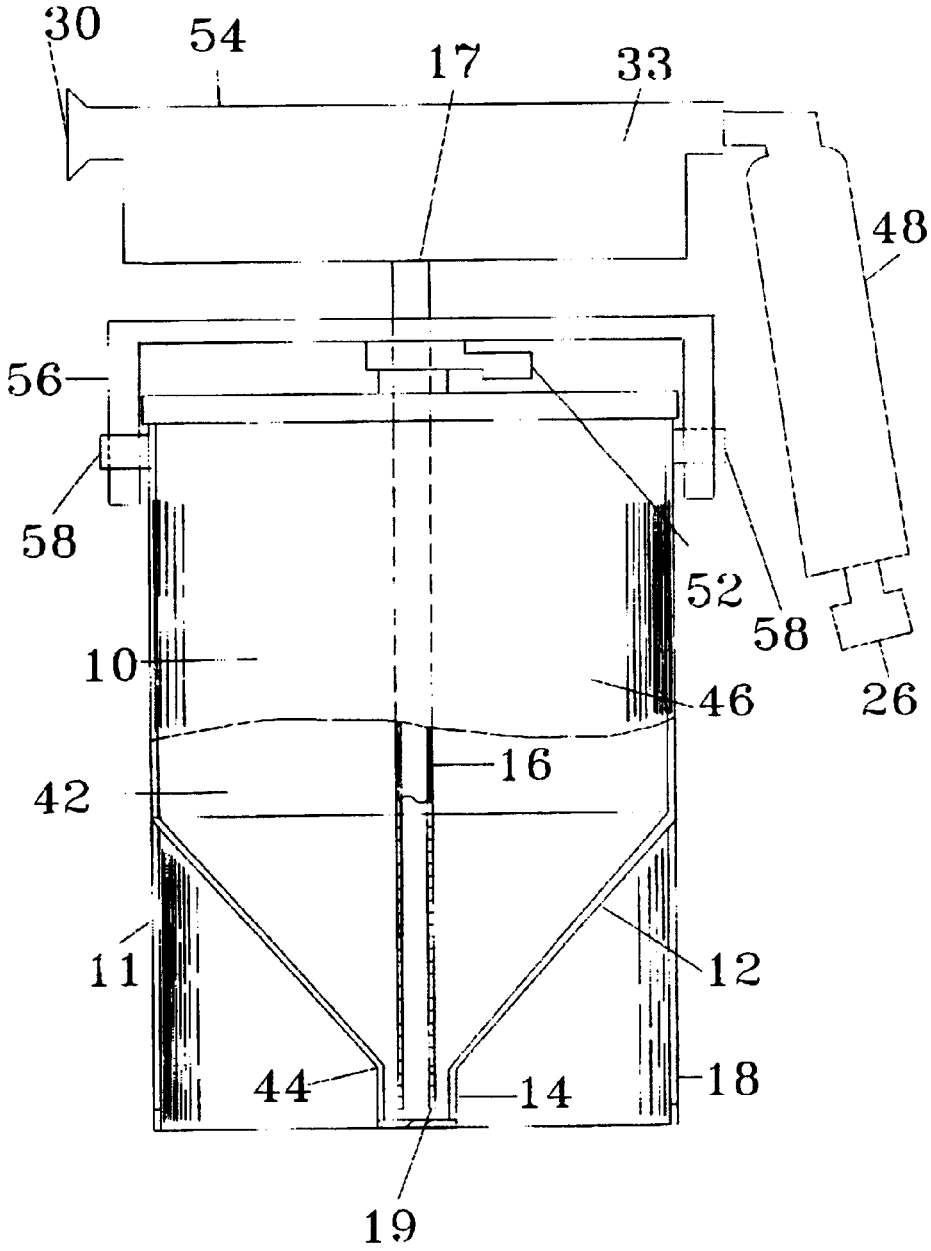
FIG. 7 is a sectional view of an applicator incorporating yet another alternative embodiment of a container of the present invention. The container is used in conjunction with a spraying apparatus which is attached to the end of a hose transporting compressed gas, such as air. The spraying apparatus includes a tube through which liquid is aspirated from, or forced from the container, by the compressed gas, and applied by the spraying apparatus.

A fourth preferred embodiment of the container 10 is illustrated in FIG. 7. The container 10 includes a downwardly sloped bottom surface 12 to which the well 14 is attached. Unlike embodiments shown in FIGS. 1, 2, 3, and 6, the second liquid 42, being held in the container, is not aspirated into a first liquid 40. The coating spray gun 54 contains a chamber 33 through which a gaseous propellant, preferably air, flows. The propellant enters the spraying apparatus 34 through the hose coupling 26, passes through the handle 48 followed by the chamber 33 and exits the spray nozzle 30. It is not necessary that the propellant pass through the handle 48. The propellant may pass directly from the hose coupling 26 to the chamber 33, also. The chamber 33 includes an aperture (not shown) into which a proximal end 17 of a suction tube 16 is inserted. As the propellant passes through the chamber 33 and past the proximal end 17 of the suction tube 16 within the chamber 33, a siphoning effect is created. When a distal end 19 of the suction tube 16 is submerged in a liquid, such as paint (not shown), in the container 10, the liquid 42 is aspirated into the propellant. The container 10, as illustrated in FIG. 7, includes a skirt 18 which extends below the well 14. The skirt 18 provides a support structure for the applicator. 11 which keeps the applicator 11 upright while the applicator 11 is not being used. In the embodiment illustrated in FIG. 7, the skirt, if used as a support structure instead of legs 28 or other means of support, may be opaque since there is no need to see the liquid in the container 10. The container 10 may be attached to the coating spray gun 54 either by a plurality of threads (not shown) similar to those in FIGS. 1, 2, 3, 4, and 6, or by employing a container attachment yoke 56 engaging container attachment pins 58 and drawing the container 10 tightly to the coating spray gun 54 by turning a cam-action container release lever 52.

The embodiment illustrated in FIG. 4 is not a preferred embodiment, but still offers most benefits of the preferred embodiments already described. The bottom surface 12 of the container 10 is downwardly slanted to a low point 44 to form a cone. The container 10, includes a skirt 18 which extends below the low point 44. The skirt 18 provides a support structure for the applicator 11 which keeps the applicator 11 upright while the applicator 11 is not being used. Preferably, the skirt 18 is made of a transparent material which allows the user of the applicator 11 to see the amount of the second liquid 42 remaining in the container 10 through the transparent or translucent sides of container 10.

The present invention is container 10 with well 14 or low point 44 combined with a hose end sprayer 34 or coating spray gun 54.

Although the present invention has been described with reference to preferred embodiments, workers skilled in the art will recognize that changes may be made in form and detail without departing from the spirit and scope of the invention.

What is claimed is:

1. A container to be used in cooperation with a spraying apparatus which is attached to an end of a hose, wherein the spraying apparatus includes a suction tube with a proximal end and a distal end, the container comprising:

a side wall extending downwardly from said mechanism, a bottom surface within the container extending inwardly from said side wall which bottom surface is downwardly sloped from said side wall to a low point with a well located at the low point such that a distal end of the suction tube is within the well.

2. The container of claim 1 wherein the bottom surface is downwardly sloped such that the low point is substantially located about a vertical axis of the container.

3. The container of claim 1 wherein the container is supported by a skirt, wherein the skirt is attached to the container.

4. The container of claim 1 wherein the container is supported by a plurality of legs, wherein the legs are attached to the container.

5. The container of claim 1 wherein the mechanism for attaching the container to the applicator is a plurality of threads.

6. The container of claim 1 wherein the mechanism for attaching the container to the applicator is a yoke engaging pins tightened by a cam.

* * * * *